US008925336B2

(12) United States Patent
Lifson et al.

(10) Patent No.: US 8,925,336 B2
(45) Date of Patent: Jan. 6, 2015

(54) REFRIGERANT SYSTEM PERFORMANCE ENHANCEMENT BY SUBCOOLING AT INTERMEDIATE TEMPERATURES

(75) Inventors: Alexander Lifson, Manlius, NY (US); Michael F. Taras, Fayetteville, NY (US)

(73) Assignee: Carrier Corporation, Farmington, CT (US)

( * ) Notice: Subject to any disclaimer, the term of this patent is extended or adjusted under 35 U.S.C. 154(b) by 1176 days.

(21) Appl. No.: 12/918,233

(22) PCT Filed: Feb. 19, 2008

(86) PCT No.: PCT/US2008/054257

§ 371 (c)(1),
(2), (4) Date: Nov. 10, 2010

(87) PCT Pub. No.: WO2009/128813

PCT Pub. Date: Oct. 22, 2009

(65) Prior Publication Data

US 2011/0041524 A1 Feb. 24, 2011

(51) Int. Cl.

| | |
|---|---|
| ***F25B 41/00*** | (2006.01) |
| ***F25B 49/00*** | (2006.01) |
| ***F25B 7/00*** | (2006.01) |
| ***F25B 39/04*** | (2006.01) |
| ***F25B 41/04*** | (2006.01) |
| ***F25B 6/04*** | (2006.01) |
| ***F25B 49/02*** | (2006.01) |

(52) U.S. Cl.

CPC . *F25B 41/04* (2013.01); *F25B 6/04* (2013.01); *F25B 49/02* (2013.01); *F25B 2400/0403* (2013.01); *F25B 2400/22* (2013.01); *F25B 2600/11* (2013.01)

USPC ..... 62/196.4; 62/79; 62/196.1; 62/507; 62/513

(58) Field of Classification Search

CPC . F25B 6/04; F25B 2400/22; F25B 2400/0403

USPC ..... 62/507, 513, 196.4, 79

See application file for complete search history.

(56) References Cited

U.S. PATENT DOCUMENTS 3,152,455 A * 10/1964 Ware ..... 62/184
4,173,865 A * 11/1979 Sawyer ..... 62/324.6

(Continued)

FOREIGN PATENT DOCUMENTS

JP 2003269752 A * 9/2003 ..... F24F 5/00

OTHER PUBLICATIONS

Machine Translation of Takazawa, Air Conditioner, Sep. 5, 2003, PAJ, JP 2003-269752, all.*

(Continued)

*Primary Examiner* — Allen Flanigan
*Assistant Examiner* — Filip Zec
(74) *Attorney, Agent, or Firm* — Cantor Colburn LLP

(57) ABSTRACT

A refrigerant system operates in an environment defined by three distinct temperature levels, such as, for instance, the outdoor ambient temperature level, the indoor temperature level and the refrigeration temperature level. The refrigerant system is provided with an air-to-refrigerant heat exchanger located within the general indoor environment and connected to receive the flow of refrigerant from a heat rejection heat exchanger. The air-to-refrigerant heat exchanger gives off heat to the indoor air and in the process further cools the refrigerant flowing to an expansion device to thereby increase the cooling effect provided by an evaporator to the refrigeration area. Provisions are also made to partially or entirely bypass the air-to-refrigerant heat exchanger and/or the heat rejection heat exchanger, on a selective basis.

11 Claims, 2 Drawing Sheets

(56) References Cited

U.S. PATENT DOCUMENTS

| | | | | |
|---|---|---|---|---|
| 6,092,377 | A * | 7/2000 | Tso | 62/173 |
| 6,581,397 | B1 | 6/2003 | Taira et al. | |
| 6,857,285 | B2 * | 2/2005 | Hebert | 62/305 |
| 2001/0013409 | A1 * | 8/2001 | Burk et al. | 165/240 |
| 2002/0023443 | A1 * | 2/2002 | Eber et al. | 62/172 |
| 2004/0069013 | A1 * | 4/2004 | Aflekt et al. | 62/507 |
| 2004/0261447 | A1 | 12/2004 | Matsuoka et al. | |

OTHER PUBLICATIONS

International Search Report and Written Opinion mailed Jul. 14, 2008 (10 pgs.).

International Preliminary Report on Patentability mailed Oct. 28, 2010 (7 pgs.).

* cited by examiner

REFRIGERANT SYSTEM PERFORMANCE ENHANCEMENT BY SUBCOOLING AT INTERMEDIATE TEMPERATURES

TECHNICAL FIELD

This invention relates generally to refrigerant systems and, more particularly, to a method and apparatus for increasing capacity of a refrigerant system by the selective use of naturally occurring temperature differences, such as between an ambient environment and a conditioned space.

BACKGROUND OF THE INVENTION

The concept of cooling a refrigerant flowing from a heat rejection heat exchanger to an expansion device in order to increase the capacity of the refrigerant system is well known. Such a refrigerant temperature reduction is most commonly accomplished in one of two ways, either by the inclusion of an economizer cycle or the use of a "liquid-suction" heat exchanger. However, each of these approaches has disadvantages. In the case of the economizer cycle, because of the need for additional components and extra complexity associated with a compressor, that has to be designed to accept vapor injection, a substantial expense is necessarily involved.

In the case of using a "liquid-suction" heat exchanger, the benefit is often limited, and under some circumstances, can actually reduce the cooling capacity of the refrigerant system. This occurs as the vapor entering the compressor is additionally superheated in the "liquid-suction" heat exchanger, which reduces the density of the refrigerant entering the compressor, and thus the refrigerant mass flow available for cooling. Therefore, the additional preheating of refrigerant as it enters the compressor often negates the effect of additional cooling provided by a "liquid-suction" heat exchanger.

There is therefore a need for increasing capacity of a refrigerant system in a simple, effective and less expensive manner.

DISCLOSURE OF THE INVENTION

In accordance with one aspect of the invention, a provision is made for including an additional air-to-refrigerant heat exchanger between an outdoor heat rejection heat exchanger and an indoor expansion device, with this heat exchanger being exposed to the indoor air temperatures to thereby further cool the refrigerant exiting the heat rejection heat exchanger, where the heat has been removed from the refrigerant by heat transfer interaction with the higher temperature ambient air, to thereby increase capacity of the refrigerant system.

In accordance with another aspect of the invention, a provision is made to bypass the additional air-to-refrigerant heat exchanger during periods in which the outdoor temperature is cooler than the indoor temperature.

In the drawings as hereinafter described, a preferred embodiment is depicted; however, various other modifications and alternate constructions can be made thereto without departing from the spirit and scope of the invention.

DETAILED DESCRIPTION OF THE INVENTION

Figure 1:
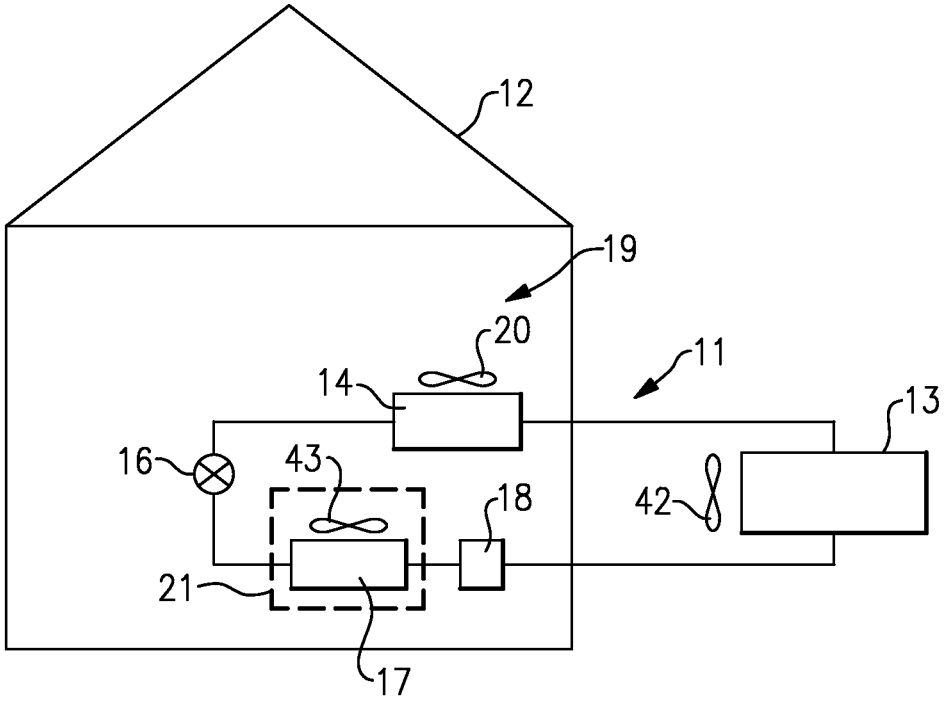
FIG. 1 is a schematic illustration of an exemplary supermarket refrigeration system with the present invention incorporated therein.

Shown in FIG. 1 is an exemplary refrigeration system 11 which may be installed in a supermarket 12 with a heat rejection heat exchanger 13 being located outside to be exposed to ambient air and being fluidly connected in serial flow relationship, to an air-to-refrigerant heat exchanger 14, an expansion device 16, an evaporator 17, and a compressor 18, all of which would be typically located within the confines of the supermarket building. An air moving device such as fan 42 is associated with the heat rejection heat exchanger 13 and an air moving device such as fan 43 is associated with the evaporator 17. In this regard, it should be understood that, generally, in larger supermarkets, the heat rejection heat exchangers associated with the large refrigeration systems are often located outdoors. The present invention is limited to such outdoor installations of the heat rejection heat exchanger 13, and particularly to installations where the outdoor temperature is, at least at times, higher than the temperature within the general area, such as for instance customer area 19, of the supermarket 12. Therefore, the invention will have a greater use in warmer climates and seasons.

The present invention is particularly adapted to installations where, at least at times, three different, descending temperature levels are involved. These temperature levels include: the ambient temperature in which the heat rejection heat exchanger 13 resides, which may be in a temperature range of 80° F. to 120° F.; the temperature within the general indoor area 19 which would normally be in the range of 70° F. to 80° F.; and the temperature of the refrigerated zone 21 which may be in the range of 35° F. to 55° F., if non-frozen, refrigerated products are displayed therein, and in the range of −20° F. to 30° F., if frozen or chilled foods are displayed therein. The air-to-refrigerant heat exchanger 14 of the present invention therefore takes advantage of these temperature differences in order to improve performance of the refrigeration system 11.

It should be noted that although the present invention references the refrigeration systems, air conditioning and heat pump systems are also within the scope and can equally benefit from the invention. As an example, if different climate-controlled zones with different temperatures levels are present within a building, a similar approach can be applied, with extra capacity obtained in the lower temperature zone due to extra cooling of the refrigerant by the air in the higher temperature zone.

In operation of the refrigeration system 11, the refrigerant flows from the heat rejection heat exchanger 13 at a temperature which is typically approaching the ambient outdoor air temperature. As it enters the air-to-refrigerant heat exchanger 14, it therefore gives off heat to the indoor environment 19 to thereby further cool the refrigerant. A fan 20 associated with the air-to-refrigerant heat exchanger 14 may be provided to enhance heat transfer interaction between the indoor air and refrigerant in the air-to refrigerant heat exchanger 14. The temperature of the refrigerant leaving the air-to-refrigerant heat exchanger 14 would now approach the indoor air temperature, and this colder refrigerant is then passed through the expansion device 16 to the evaporator 17 for cooling the refrigerated environment 21, such as, for example a display case or a cold room. Due to a lower temperature of the refrigerant entering the expansion device 16, it is possible to provide a greater cooling effect in the evaporator 17 then would be possible using refrigerant with the refrigerant with temperature approximated by the ambient air temperature at the entrance to the expansion device 16. In this way, the amount of cooling delivered to the refrigerated environment 21 by the refrigeration system 11 will be increased while the total amount of cooling delivered to the supermarket considered as a whole will remain roughly the same. That is, the amount of additional cooling provided to the refrigerated environment 21 would be approximately equal to the amount of heat dissipated into the general indoor area 19. However, the net effect may be slightly positive, since the air-to-refrigerant heat exchanger 14 would slightly unload the outdoor heat rejection heat exchanger 13, thus reducing power consumption for the compressor 18.

Figure 2:
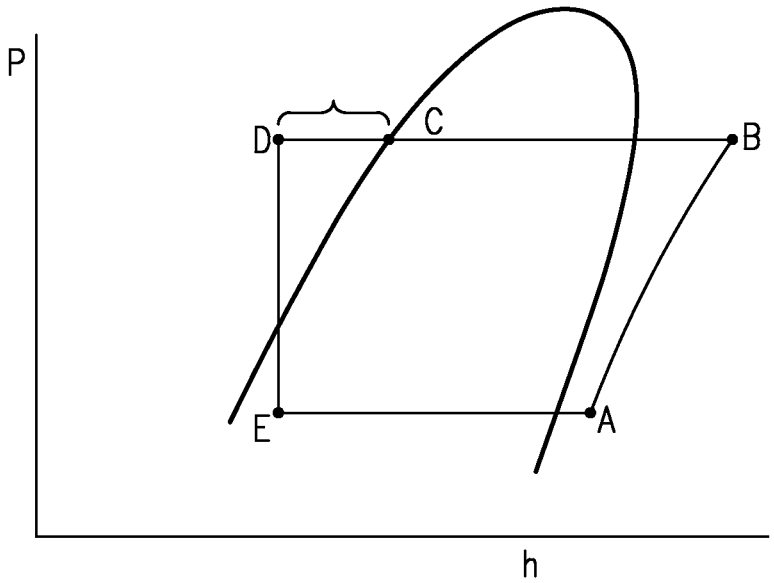
FIG. 2 is a graphic illustration of a P-h diagram showing the benefit of the present invention.

Referring now to FIG. 2, a pressure-enthalpy (P-h) diagram is shown to illustrate the effect of the present invention. That is, after the vapor refrigerant is compressed in the vapor compression cycle from point A to point B, the heat rejection heat exchanger 13 causes the refrigerant enthalpy to be reduced from point B to point C, due to heat transfer interaction with outside ambient air. The air-to-refrigerant heat exchanger 14 then further reduces the refrigerant enthalpy from point C to point D. As the refrigerant passes through the expansion device 16 its pressure is reduced as shown by the line D-E while the refrigerant enthalpy is kept constant. Further, the refrigerant enthalpy is increased in the evaporator 17 as shown by the line E-A. It can thus be seen that the reduction in refrigerant enthalpy from point C to point D in the air-to-refrigerant heat exchanger 14 results in a greater refrigerant enthalpy change in the evaporator 17, and thus a greater cooling potential of the refrigerant transverse the evaporator 17, as indicated by the line E-A.

Figure 3:
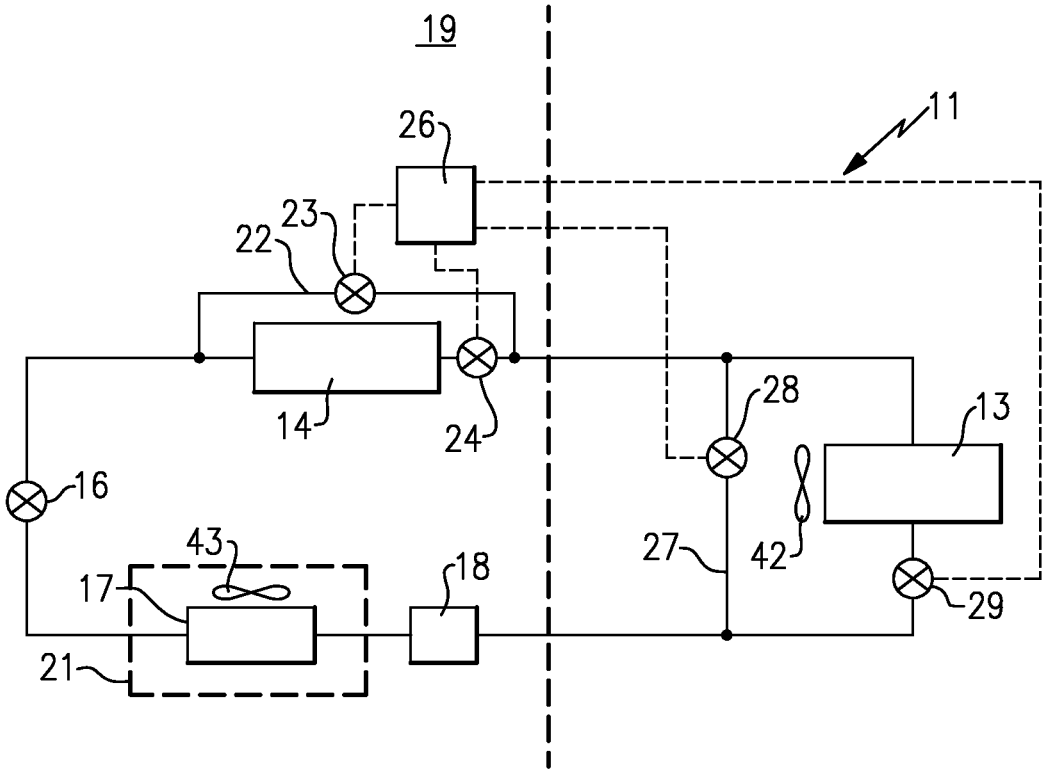
FIG. 3 is a schematic illustration of an alternative embodiment of the invention.

Recognizing that there will be periods of operation in which the outdoor temperature will be lower or substantially equal to the air temperature within the general indoor area 19, a provision is made to selectively bypass at least a portion of refrigerant around at least portions of either the heat rejection heat exchanger 13 or the air-to-refrigerant heat exchanger 14 as shown in FIG. 3.

A bypass line 22 is provided to selectively bypass at least a portion of refrigerant around the air-to-refrigerant heat exchanger 14 to the extent permitted by operation of the refrigerant flow control devices such as valves 23 and 24 which are controlled by a control 26. That is, if the valve 24 is closed and the valve 23 is opened, the air-to-refrigerant heat exchanger 14 will be completely bypassed by the refrigerant. Contrariwise, if the valve 23 is closed and the valve 24 is opened, then the entire flow of the refrigerant will flow through the air-to-refrigerant heat exchanger 14. Of course, the valve 23 and 24 can be placed in intermediate positions so as to selectively determine the degree of the bypass refrigerant flow. The two valves 23 and 24 can be substituted by a single three-way valve as well.

Similarly, a bypass line 27, and associated valves 28 and 29, which are controlled by the control 26, allow for the selective adjustment of the amount of compressed refrigerant vapor coming from the compressor 18 that bypasses the heat rejection heat exchanger 13. For example, depending on the relative temperatures between the outdoor and indoor environments, it may be desirable for at least a portion of the refrigerant to at least partially bypass the heat rejection heat exchanger 13 and allow the air-to-refrigerant heat exchanger 14 to contribute more to the heat rejection process. This would be desirable, for instance, when heating is desired in the general indoor space 19.

It has to be pointed out that the control of the heat rejection capability of either heat rejection heat exchanger 13 or air-to-refrigerant heat exchanger 14, as well as shift of the heat flux from one heat exchanger to another, can be accomplished by the airflow control (rather than refrigerant flow control) that can be achieved, for example, by the way of a variable speed fan associated with at least one of the heat exchangers or a selective shutoff of the associated fans in the multi-fan air management system configurations.

Also, it has to be understood that the air-to-refrigerant heat exchanger 14 may be represented by a refrigerant line having heat transfer enhancement elements on its surface.

Furthermore, it has to be understood that the present invention would be particularly beneficial in the case of the $CO_2$ refrigerant utilized, for instance, in the supermarket refrigeration system 11, where, in the transcritical operation, any means of capacity enhancement are highly desirable to compensate for the cycle deficiency.

While the present invention has been particularly shown and described with reference to a preferred and modified embodiments as illustrated in the drawings, it will be understood by one skilled in the art that various changes in detail may be made thereto without departing from the spirit and scope of the invention as defined by the claims.

We claim:

1. A method of increasing capacity of a refrigerant system including, in serial refrigerant flow relationship, a compressor, a heat rejection heat exchanger with an associated air moving device, an expansion device and an evaporator wherein said heat rejection heat exchanger is exposed to a first environment with a first temperature level there within and said evaporator is exposed to a second environment with a second temperature level there within, with said second temperature level being lower than said first temperature level, and wherein there is a third environment with a third temperature level which is, at least at times, intermediate said first temperature level and said second temperature level, comprising:

positioning an additional air-to-refrigerant heat exchanger to be exposed to said third environment and fluidly interconnecting said air-to-refrigerant heat exchanger between said heat rejection heat exchanger and said expansion device, with respect to refrigerant flow, such that additional cooling can be selectively provided to the refrigerant flowing though said air-to-refrigerant heat exchanger during the time periods when the temperature of the air within the third environment is lower than the temperature of the air within the first environment;

wherein the refrigerant system includes a bypass circuit around said air-to-refrigerant heat exchanger and a control, and the method includes selectively bypassing at least a portion of refrigerant around at least a portion of said air-to-refrigerant heat exchanger when the temperature in the first environment is equal to or less than the temperature in the third environment.

2. A method as set forth in claim 1 wherein said first environment is an ambient environment, said second environment is a refrigeration environment and said third environment is a general indoor environment, the refrigeration environment being at least 15 degrees colder than the general indoor environment.

3. A method as set forth in claim 1 wherein said first environment is an ambient environment, said second environment is a higher temperature level climate-controlled zone and said third environment is a lower temperature level climate-controlled zone.

4. A method as set forth in claim 1 wherein said refrigerant system is one of a refrigeration system, an air conditioning system and a heat pump system.

5. A method as set forth in claim 1 wherein the refrigerant within said refrigerant system is C02.

6. A method as set forth in claim 1 wherein said air-to-refrigerant heat exchanger is a refrigerant line having heat transfer enhancement elements.

7. A method as set forth in claim 1 wherein said refrigerant system includes an air moving device associated with said air-to-refrigerant heat exchanger to move air across the air-to-refrigerant heat exchanger.

8. A method as set forth in claim 7 wherein at least one of said air moving device associated with said heat rejection heat exchanger and said air moving device associated with said air-to-refrigerant heat exchanger has a capability to provide variable airflow and the method includes utilizing said variable airflow capability to selectively shift heat rejection heat flux between said heat rejection heat exchanger and said air-to-refrigerant heat exchanger.

9. A method as set forth in claim 1 wherein the refrigerant system includes at least one refrigerant flow control device to selectively bypass refrigerant around said air-to-refrigerant heat exchanger.

10. A method as set forth in claim 1 wherein the refrigerant system includes a bypass circuit around said heat rejection heat exchanger and a control, and the method includes selectively bypassing at least a portion of refrigerant around at least a portion of said heat rejection heat exchanger.

11. A method as set forth in claim 10 wherein the refrigerant system includes at least one refrigerant flow control device to selectively bypass refrigerant around said heat rejection heat exchanger.

* * * * *